US006494002B1

(12) United States Patent
Gieseke

(10) Patent No.: US 6,494,002 B1
(45) Date of Patent: Dec. 17, 2002

(54) MUNTIN BAR CLIP WITH SPIKES

(76) Inventor: Gerald G. Gieseke, P.O. Box 566, Tieton, WA (US) 98947

( * ) Notice: Subject to any disclaimer, the term of this patent is extended or adjusted under 35 U.S.C. 154(b) by 0 days.

(21) Appl. No.: 09/692,841

(22) Filed: Oct. 19, 2000

(51) Int. Cl.[7] ..... E06B 3/68
(52) U.S. Cl. ..... 52/204.61; 52/713; 52/714
(58) Field of Search ..... 52/314, 456, 713, 52/714, 204.61

(56) References Cited

U.S. PATENT DOCUMENTS

| | | | | | |
|---|---|---|---|---|---|
| 3,099,865 | A | | 8/1963 | Burnett | 20/40 |
| 3,108,336 | A | | 10/1963 | Tate | 20/56 |
| 3,293,817 | A | | 12/1966 | Mac Gregor | 52/456 |
| 3,307,316 | A | | 3/1967 | Gray | 52/507 |
| 3,340,661 | A | | 9/1967 | Krieger | 52/456 |
| 3,372,522 | A | * | 3/1968 | Engstrom | 52/456 |
| 3,504,468 | A | * | 4/1970 | Martin | 52/204.61 |
| 3,645,058 | A | | 2/1972 | Jacobson | 52/456 |
| 3,686,814 | A | | 8/1972 | Anderson | 52/456 |
| 3,708,939 | A | * | 1/1973 | Herr | 52/204.61 |
| 3,791,095 | A | | 2/1974 | Martin | 52/758 |
| 4,060,950 | A | | 12/1977 | Rackard et al. | 52/456 |
| 4,437,284 | A | | 3/1984 | Cribben | 52/456 |
| 4,467,578 | A | * | 8/1984 | Weinar | 52/714 |
| 4,621,473 | A | * | 11/1986 | Wendt | 52/714 |
| 4,644,721 | A | | 2/1987 | Bloomquost | 52/456 |
| 4,838,001 | A | * | 6/1989 | Battles | 52/456 |
| 4,854,100 | A | * | 8/1989 | La See | 52/456 |
| 4,890,435 | A | | 1/1990 | Wilkening | 52/456 |
| 4,949,521 | A | | 8/1990 | Riegelmar et al. | 52/456 |
| 4,970,840 | A | | 11/1990 | Quellette | 52/311 |
| 4,989,384 | A | | 2/1991 | Kinghora | 52/456 |
| 5,048,252 | A | | 9/1991 | Osborn | 52/456 |
| 5,154,034 | A | | 10/1992 | Stanek | 52/766 |
| 5,313,761 | A | | 5/1994 | Leopold | 52/788 |
| 5,325,579 | A | | 7/1994 | Baier | 29/462 |
| 5,363,625 | A | | 11/1994 | Philippi | 52/653.2 |
| 5,574,651 | A | | 11/1996 | McKeegan et al. | 364/474.02 |
| 5,678,376 | A | | 10/1997 | Poma | 52/656.8 |
| 5,678,377 | A | | 10/1997 | Leopold | 52/656.9 |
| 6,128,871 | A | * | 10/2000 | Corey | 52/314 |
| 6,131,356 | A | | 10/2000 | Gieseke | 52/656.8 |

* cited by examiner

*Primary Examiner*—Michael Safavi
(74) *Attorney, Agent, or Firm*—Liebler, Ivey & Connor; Floyd E. Ivey

(57) ABSTRACT

An apparatus of a muntin bar clip to secure the position of muntin bars during and following the fabrication of multi-pane sealed glass window units. A method of securing and positioning muntin bars at multi-pane sealed glass window unit perimeters and in joining hollow false muntin bars within such units. Muntin bar clips fix the position of hollow false muntin bars at the perimeter of the window unit utilizing the sealing methods including foam strips and or butyl as the sealing medium. Muntin bar clips fix the position of hollow false muntin bars at the perimeter of the window unit where the false muntin bar is other than orthogonal in relation to the perimeter of the window. The position of muntin bars are fixed by securing the muntin bar clips by forming at a muntin bar clip tip end one or a plurality of spikes wherein the penetration, of one or a plurality of spikes, into the material of the sealing and or spacing method employed secures the position of the muntin bar. The apparatus lessens the likelihood of either breaking or cracking the glass panes, as multi-pane sealed unit assembly occurs, or of causing seal failure of such units either during manufacture or following installation and increases the likelihood of securing the muntin bars into permanent position.

8 Claims, 7 Drawing Sheets

MUNTIN BAR CLIP WITH SPIKES

FIELD OF THE INVENTION

The present invention relates generally to an apparatus of a muntin bar clip to secure the position of muntin bars during and following the fabrication of multi-pane sealed glass window units. The disclosure relates to securing and positioning muntin bars at multi-pane sealed glass window unit perimeters and in joining hollow false muntin bars within such units. The invention relates particularly to muntin bar clips intended to fix the position of hollow false muntin bars at the perimeter of the window unit utilizing the sealing methods including foam strips and/or butyl as the sealing medium. The disclosed invention more particularly relates to muntin bar clips for the purpose of fixing the position of hollow false muntin bars at the perimeter of the window unit where the false muntin bar is other than orthogonal in relation to the perimeter of the window. The invention more specifically provides the fixing of the position of muntin bars in addition to lessening the likelihood of either breaking or cracking the glass panes, as multi-pane sealed unit assembly occurs, or of causing seal failure of such units either during manufacture or following installation.

BACKGROUND OF THE INVENTION

Sealed multi-pane sealed window units have become standard for new and renovation construction within industrialized nations. Architectural detail is provided by the fixing of false muntin bars between panes of glass within such units. Such detail frequently requires multiple false muntin bars to intersect to form distinct patterns within the unit. The positioning of muntin bars commonly results in muntin bar ends intersecting with the perimeter of a window unit in other than an orthogonal relationship between the muntin bar and the unit perimeter forming, for example, a sunburst or radiating pattern. The securing of muntin bars in place during and following manufacture is critical in that any shifting from proper alignment will result in an unacceptable appearance. The method of or apparatus securing muntin bars, at the perimeter of such units, must not interfere with the sealing method of the unit. A method of fixing the position of muntin bars at a window unit perimeter has included the fixing of a pin at the muntin bar end with the pin to be received into a hole prepared in the window unit perimeter at the frame. The pin and hole combination required additional manufacturing steps and, in the case of sealed units, created potential sealant breaches.

The advent of new manufacturing techniques and the production of foam strip sealed and butyl sealed inert gas filled window units renders problematic or unusable methods or apparatus, for the positioning of muntin bars, disclosed in the prior art. Maintenance of gas integrity within such units is of paramount importance in insuring continued heat exchange properties and eliminating the potential for formation of condensation within the interior of the unit. Existing prior art is unlikely to provide for the maintenance of such characteristics with a substantial likelihood that the interior of sealed units will experience a breach of the seal. The apparatus disclosed herein is principally adapted for use with foam strip, butyl and other similar pliable or flexible seal systems.

Prior art which is distinguished includes the following which, along with additional patents, are disclosed in an information disclosure statement. U.S. Pat. No. 6,131,356 to Gieseke discloses muntin bar clips with tip 43 terminating in a blunt end 50 and alternatively one or more prongs 45. U.S. Pat. No. 3,686,814 to Anderson discloses a barbed clip for use with wood frames and a clip suitable for locking behind a bead on a metal window frame. U.S. Pat. No. 4,644,721 to Bloomquist et al. relates to a clip for securing a muntin bar in a single pane window for ease of removal of the muntin bar for cleaning purposes. U.S. Pat. No. 4,890,435 to Wilkening et al. demonstrates a method of mounting muntin bars on the exterior of a multi-pane unit. U.S. Pat. No. 4,060,950 to Rackard et al. discloses a clip for the interconnection of muntin bars at their point of crossing. U.S. Pat. No. 5,574,651 to McKeegan et al. discloses a keeper at the end of a muntin bar having a protrusion secured within an aperture within the frame. U.S. Pat. No. 3,108,336 to Tate demonstrates an end clip limited to an orthogonal orientation. U.S. Pat. No. 5,154,034 to Stanek shows an edge clip with a pad form element in contact with the seal material causing a pressure point break of the seal integrity with the window perimeter. U.S. Pat. No. 3,791,095 to Martin illustrates edge clips with a semi-circular edge sized to fit within one-sixteenth inch bores in the spacing strips. U.S. Pat. No. 5,678,376 to Poma demonstrates edge clips with protrusions received into apertures in the frame. U.S. Pat. No. 5,325,579 to Baier shows a multi-pane structure with a muntin bar grid. U.S. Pat. No. 4,437,284 to Cribben et al. shows muntin bars fixed with pins at the frame. U.S. Pat. No. 3,307,316 to Gray shows a pin fixing method at the frame. U.S. Pat. No. 4,989,384 to Kinghorn et al. illustrates a locating pin received in an opening in the perimeter bar. U.S. Pat. No. 3,645,058 to Jacobson discloses muntin bars with cam or wedge locking with a window sash. U.S. Pat. No. 3,340,661 to Krieger illustrates an edge clip composed of a tongue member received into a slot and a toothed member engaging a wood sash frame member. U.S. Pat. No. 4,949,521 to Riegelman et al. disclosed external muntin bars affixed with screw means. U.S. Pat. No. 4,970,840 to Ouellette et al. discloses a muntin end piece bearing a stud which snap fits into a hollow of the sash. U.S. Pat. No. 3,099,865 to Burnett demonstrates a magnetic pin means of securing muntin bars in place. U.S. Pat. No. 5,363,625 to Philippi shows a structural framework having end portions fixed in place by posts received into sockets . U.S. Pat. Nos. 5,313,761 and 5,678,377 to Leopold shows an edge clip having fingers received into a hollow muntin bar and secured a sash by laches received through apertures in the sash. U.S. Pat. No. 5,048,252 to Osborn illustrates muntin bars fixed with cam locks. U.S. Pat. No. 3,293,817 to MacGregor shows muntin bars fixed by a stud, at the sash, received into a slot in the muntin bar. The patents referred to herein are provided herewith in an Information Disclosure Statement in accordance with 37 CFR 1.97.

SUMMARY OF THE INVENTION

The muntin bar clip of U.S. Pat. No. 6,131,356 to Gieseke disclosed a muntin bar clip having a post, which is received into and friction secured into a hollow muntin, and a tip, distal from the post, terminating in a tip end formed as either a blunt end or prongs. The disclosure of this invention is an improvement over U.S. Pat. No. 6,131,356 to Gieseke which relies on friction securing of a muntin clip tip end between a pane and spacing and or sealing means; the improvement is one or a plurality of spikes formed at the muntin bar clip tip end at the blunt end or prongs providing a penetration of the one or a plurality of spikes into the spacing and or sealing means. The muntin bar clip installation, in relation to the glass pane and a spacing means, composed for example of a foam strip including a SUPER SPACER® is such that the tip end is placed between the pane and the spacing means. The one or a plurality of spikes are inserted or forced into the spacing means thus securing the muntin bar clip and precluding movement of the muntin bar.

The improved muntin bar clip disclosed herein is directed particularly to use with the multi-pane sealed unit. Several sealing methods or sealing means in the prior art, as discussed in U.S. Pat. No. 6,131,356 to Gieseke, are recognized within the industry. These generally employ a spacing means, which serves a sealing function in addition to insuring correct spacing between panes, and an additional sealing means at the window perimeter. Spacing and sealing means includes the use of a solid butyl strip spaced between panes with a metal strip; the butyl strip used in this process is known as a swiggle strip. Another method of sealing multi-pane sealed window units is the use of an inner foam strip having an outer butyl seal; this method may be known as a SUPER SPACER®. The foam strip of the SUPER SPACER® is generally a butyl or plastic spacer which separates glass panes in the multi-pane sealed unit. Used with the SUPER SPACER®, as a final sealing medium, is an outer butyl seal in contact with each pane and the plastic strip, completing the sealing function. Other spacing and sealing techniques are known to those in the window arts which will find the present invention to have utility. The multi-pane construction is accomplished with the intent of 1) providing a sealed unit capable of maintaining the sealed integrity during manufacture through shipping, installation and finally use over the years following installation and 2) insuring that muntin bars remain positioned as at the time of manufacture. The spikes of this improvement invention are principally anticipated to be inserted or forced into the spacing means, in whatever form utilized including that above described. Other techniques, employing a combination spacing and sealing means will utilize the placement of the spikes, at the tip end of the muntin bar clip, into the combination spacing and sealing means. Whatever the spacing and sealing means utilized, the muntin bar tip end, of this improvement, will inserted between the pane and said spacing/sealing means and anchored into position by the spikes at the muntin bar clip tip end.

Multi-pane construction generally includes positioning of muntin bars, between window panes, for architectural detail. Hollow false muntin bars facilitate the formation of patterns desired by the consumer. Muntin bars are interconnected within the unit, for pattern formation, and positioned at the edge of the window unit with muntin bar clips. The post of a muntin bar clip is received into the hollow muntin bar end which is either to be joined with other muntin bars for pattern formation or which is to be positioned at the window edge. Where pattern formation is to be achieved the muntin bar clip may have a plurality of posts interconnected with a swivel means. Where a muntin bar is to be positioned at a window unit perimeter the muntin bar clip will have a tip having a tip end, distal from the post, which is received between a pane and the spacing means, including a spacing structure and/or sealing structure, separating panes in the multi-pane sealed window unit at the perimeter. The tip end of this disclosure is distinguished from that of U.S. Pat. No. 6,131,356 to Gieseke where the tip end terminated in a blunt end or prongs and the tip end was received into the spacer or between the pane and spacer. In this disclosure the tip end of the muntin bar clip is received between the spacing means, composed generally of a firm butyl or plastic strip and composed, in the preferred embodiment of a SUPER SPACER®, and the pane. The tip end at the blunt end or prong of this disclosure is improved and distinguished by the formation, by means including a stamping or metal forming process, of at least one or a plurality of spikes formed at the tip end. The one or a plurality of spikes may be formed with any shape and dimension capable of being forced into penetration with the spacing and or sealing means but is, in the preferred embodiment, generally cut or stamped in a triangular shape to form a sharp point. The one or a plurality of spikes are generally orthogonal to the plane of the blunt end or prongs; the spike will be directed toward the post generally parallel to the offset. The metal forming means will make the appropriate cuts, will force the resulting tab, denoted here as one or a plurality of spikes, to bend into a the desired position leaving an aperture, denoted here a stamping aperture, at the tip end or blunt end. The tip end will be received between the pane and the spacing means such that the at least one spike or one or a plurality of spikes penetrates the spacing means thus insuring the retention of the muntin bar clip and hence muntin bar in the desired position and lessening the possibility of movement of the muntin bar clip and muntin bar following placement. The prior art demonstrates a variety of means for receiving the clip into a hollow muntin bar and the receipt of a tip, post or pin into a structure at the perimeter of a window unit.

BRIEF DESCRIPTION OF THE DRAWINGS

The foregoing and other features and advantages of the present invention will become more readily appreciated as the same become better understood by reference to the following detailed description of the preferred embodiment of the invention when taken in conjunction with the accompanying drawings, wherein.

Figure 2:
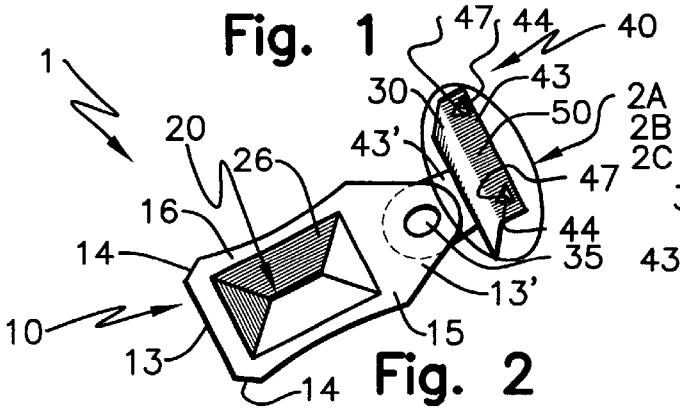
FIG. 2 is a perspective of an alternative embodiment of a muntin bar clip 1 with a post 10, a post end 13 with post end bevels 14 and a post surface 15 having a first and second side 16, 17; a fastener means 20, formed at the post surface 15 from the first to the second side 16, 17, having a dimple 26; a post second end 13 distal from the post end 13; a tip 40 having a tip end 43 distal from the post end 13 terminating in a blunt end 50; seen at the blunt end 50 are one or a plurality of spikes 44 generally orthogonal to the plane of the blunt end 45 and parallel to the offset 30; the tip 40 has a tip second end 43' distal from the tip end 43; the one or a plurality of spikes 44 project toward the tip second end 43. Illustrated is the stamping aperture 47 formed when the one or a plurality of spikes 44 is bent into position. An offset 30 formed intermediate the tip 40 and the tip second end 43'. Connecting means 35 connects the post 10 and the tip 40 at the post second end 13 and the tip second end 43' such that the post 10 and the tip 40 are rotatably secured by the connecting means which provides a swivel function.
Figure 1B:
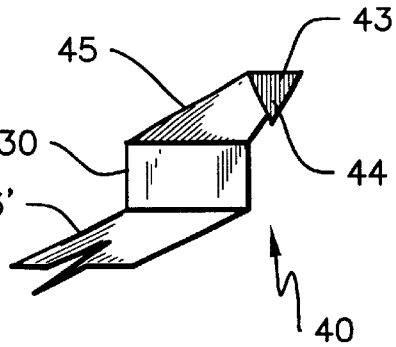
Figure 3:
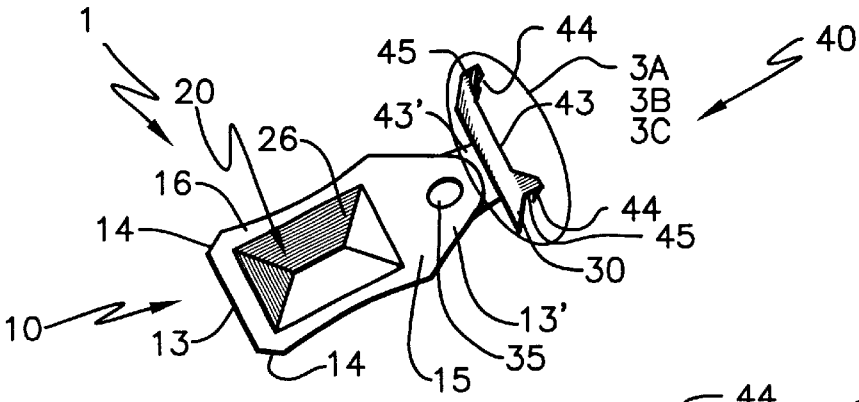

FIG. 3 is a perspective of an additional embodiment of muntin bar clip 1 of FIG. 2 showing the tip 40 with tip end 43 having one or a plurality of prongs 45 showing a spike 44 formed at each prong 45.

Figure 3A:
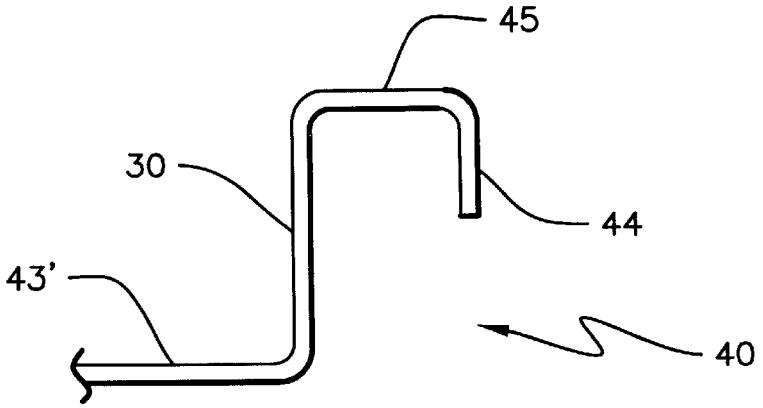
Figure 3B:
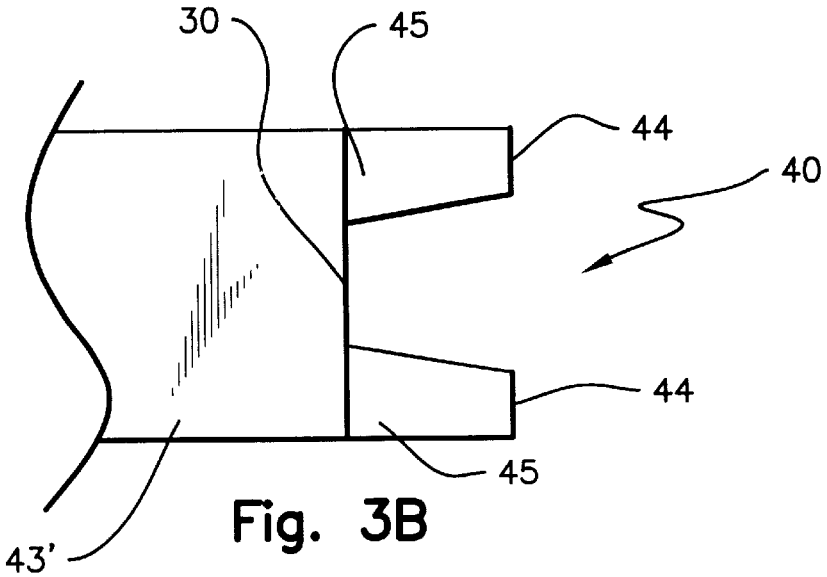
Figure 3C:
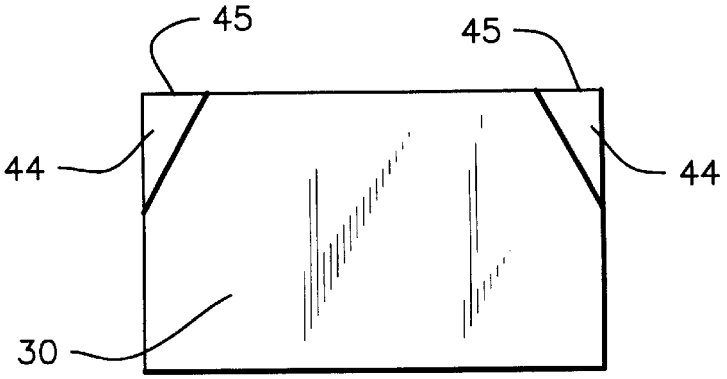

FIGS. 3A, 3B and 3C are, respectively, a side elevation, a top plan and a front elevation of the muntin bar clip 40 from tip end 43 to tip second end 43'. Illustrated is the offset 30, tip end 43, prongs 45 and spikes 44. The depiction in these drawings reveal a typical means of forming the one or a plurality of spikes 44 in this embodiment by bending the prong 45 to form the spike 44 to be generally parallel to the offset 30.

Figure 4:
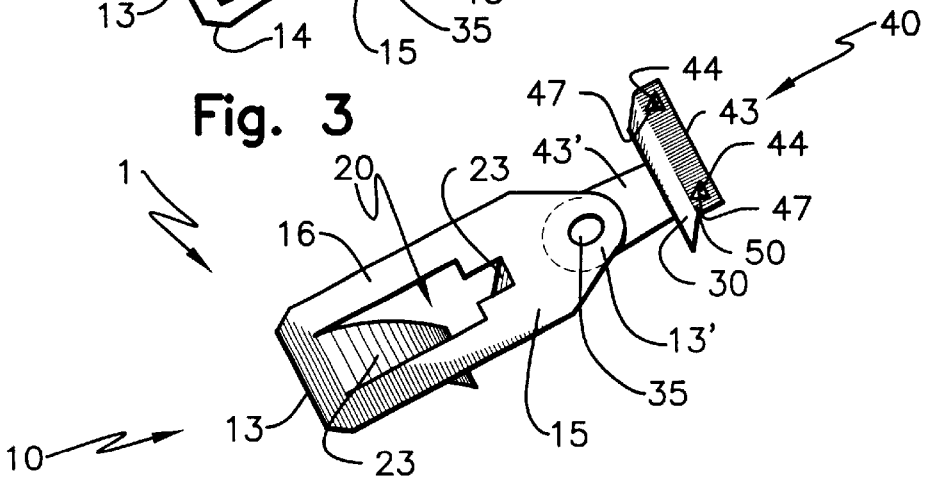
Figure 2A:
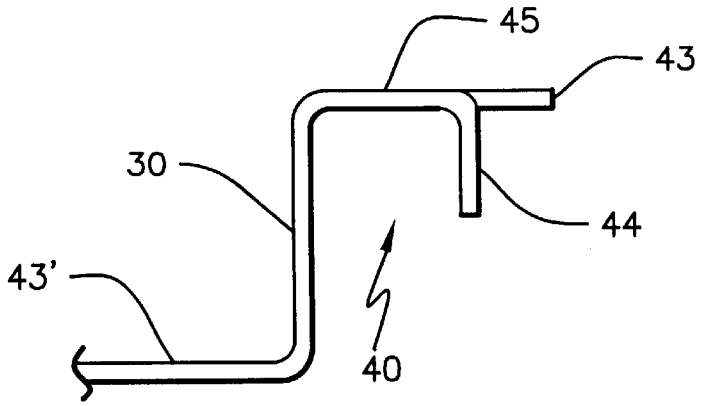
FIGS. 2A ,2B and 2C are, respectively, a side elevation, a top plan and a front elevation of the muntin bar clip tip 40 from tip end 43 to tip second end 43'. Illustrated is the tip second end 43' offset 30, blunt end 50, tip end 43 and one or a plurality of spikes 44. The depiction in these drawings reveal a typical means of forming the one or a plurality of spikes 44 by a stamping process forming cuts followed by bending the resulting tab to be generally orthogonal to the plane of the blunt end 50 and generally parallel to the offset 30. The cut in the preferred embodiment is a two sided cut resulting in a sharp pointed triangular tab or spike 44. Illustrated is the stamping aperture 47.
Figure 2B:
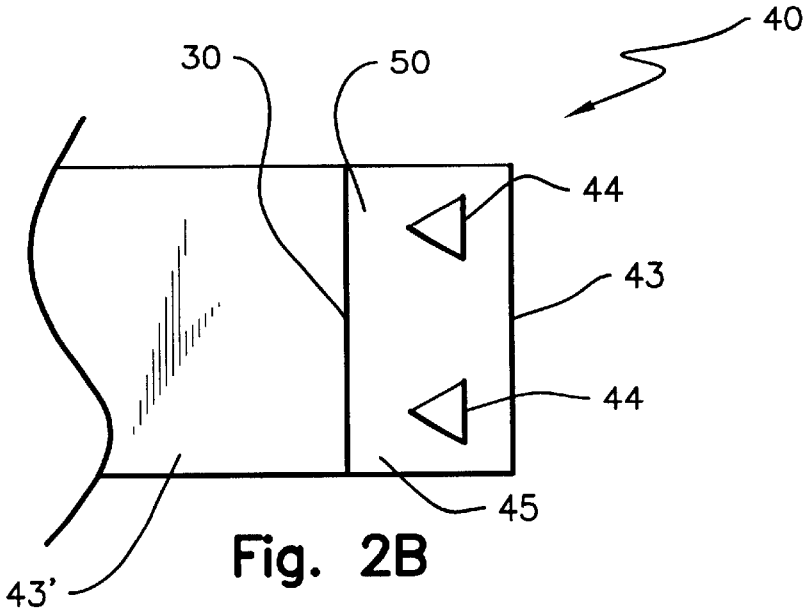
Figure 2C:
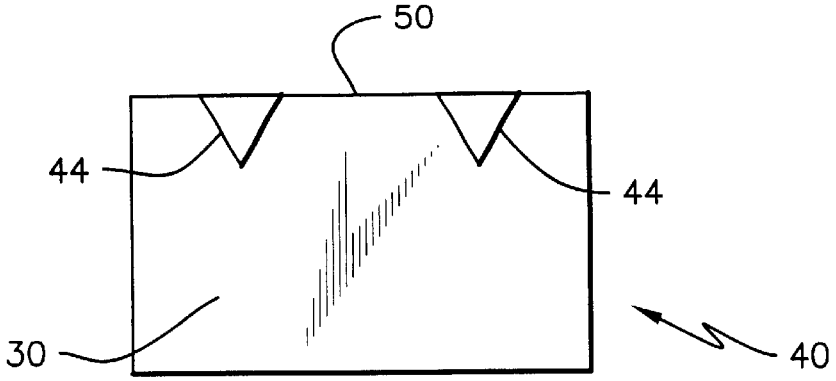

FIG. 4 is a perspective of the muntin bar clip 1 showing a fastener means 20 provided by tang springs 23 and illustrating one or a plurality of spikes 44. Also shown are stamping apertures 47.

Figure 5:
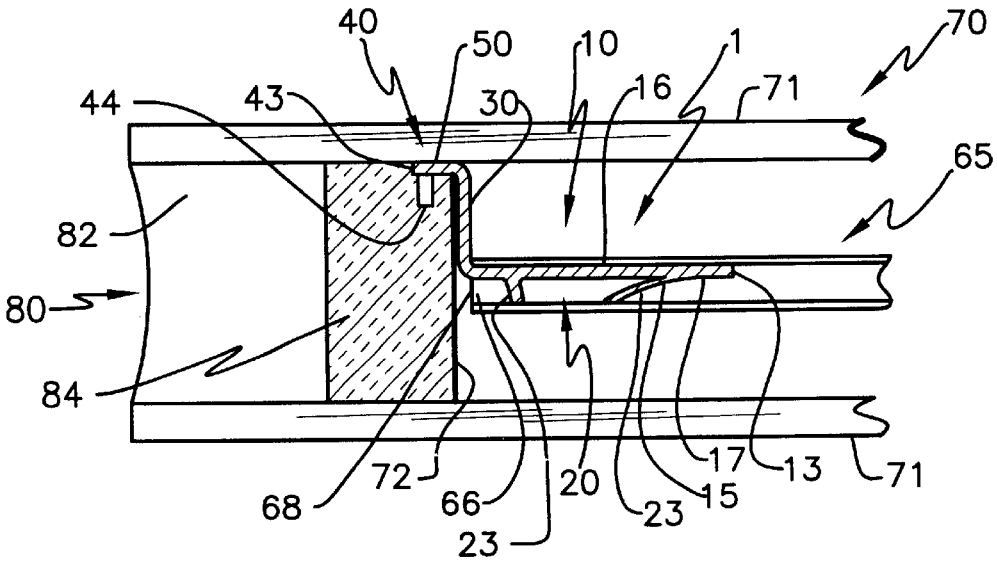

FIG. 5 is section from a side elevation showing a multi-pane sealed window unit 70 having panes 71, a perimeter 72 and a hollow false muntin bar 65, shown in elevation section, having an aperture 66 and end 68; a muntin bar clip 1 with a post 10, a post end 13 with a post surface 15 having a first and second side 16, 17; a fastener means 20, formed at the post surface 15 from the first to the second side 16, 17, having one or a plurality of tang springs 23; a tip 40 having a tip end 43 distal from the post end 13 terminating in a blunt end 50 with illustrated one or a plurality of spikes 44; an offset 30 formed intermediate the tip 40 and the fastener means 20. Also shown is the sealing structure 80 composed of butyl 82, and spacing means composed of a foam strip depicted as a SUPER SPACER® 84. The blunt end 50 is shown positioned between the pane 71 and Super Spacer 84 at the perimeter 72. The one or a plurality of spikes 44 are shown penetrating the SUPER SPACER® 84.

Figure 6:
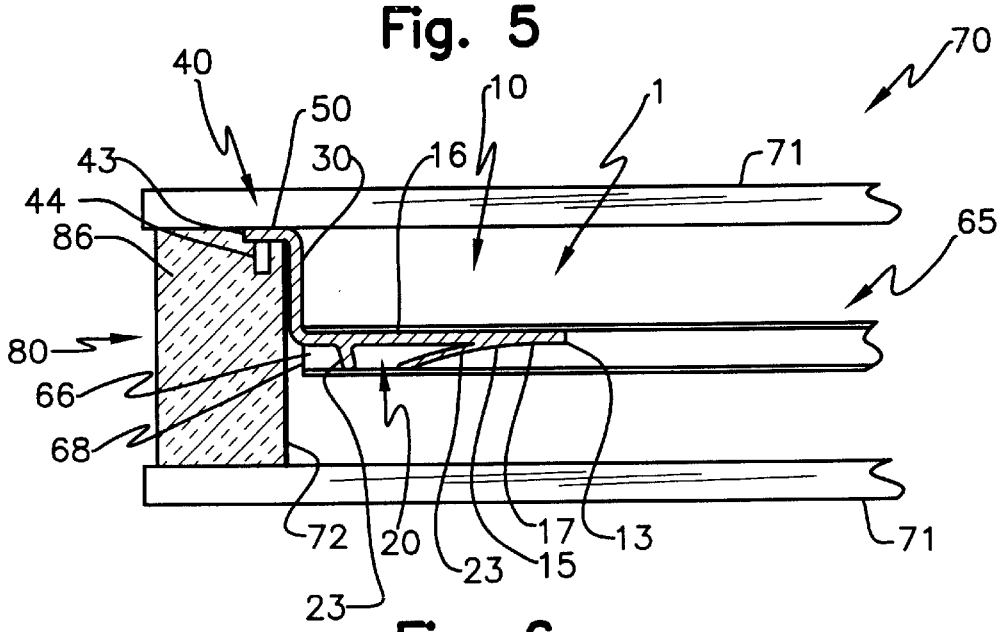

FIG. 6 is section from a side elevation showing a multi-pane sealed window unit 70 having panes 71, a perimeter 72 and a hollow false muntin bar 65, shown in elevation section, having an aperture 66 and end 68; a muntin bar clip 1 with a post 10, a post end 13 with a post surface 15 having a first and second side 16, 17; a fastener means 20, formed at the post surface 15 from the first to the second side 16, 17, having one or a plurality of tang springs 23; a tip 40 having a tip end 43 distal from the post end 13 terminating in a blunt end 50 with illustrated one or a plurality of spikes 44; an offset 30 formed intermediate the tip 40 and the fastener means 20. Also shown is the sealing structure 80 composed of swiggle strip 86. The blunt end 50 is shown positioned between the pane 71 and swiggle strip 86 at the perimeter 72. The one or a plurality of spikes 44 are shown penetrating the swiggle strip 86.

Figure 7:
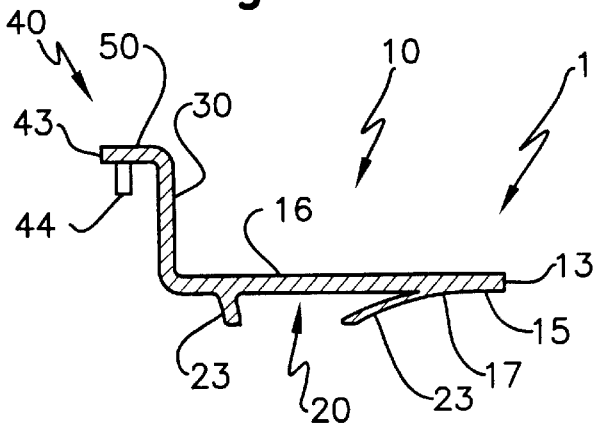

FIG. 7 is side elevation showing a muntin bar clip 1 with a post 10, a post end 13 with a post surface 15 having a first and second side 16, 17; a fastener means 20, formed at the post surface 15 from the first to the second side 16, 17, having one or a plurality of tang springs 23; a tip 40 having a tip end 43 distal from the post end 13 terminating in a blunt end 50 with illustrated one or a plurality of spikes 44; an offset 30 formed intermediate the tip 40 and the fastener means 20.

Figure 8:
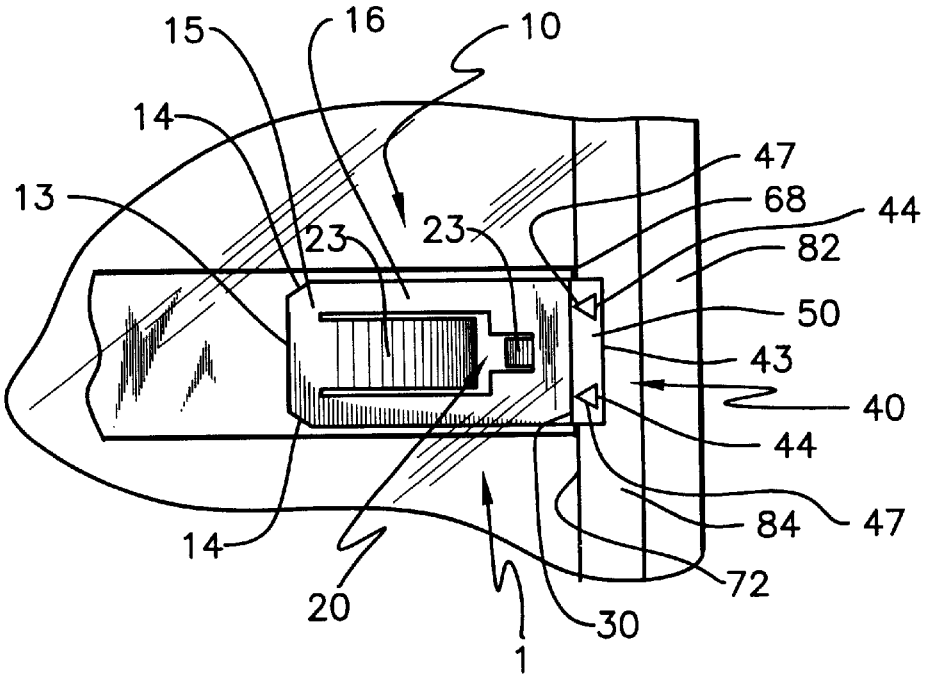

FIG. 8 is a section view of a muntin bar 65 showing a plan view of a muntin bar clip 1. The figure illustrates the use of the invention with a sealing structure 80 comprised of butyl 82, SUPER SPACER® 84 with the blunt end 50 illustrated with one or a plurality of spikes 44. Illustrated is the blunt end 50 positioned between a pane and the SUPER SPACER® 84 with the one or a plurality of spikes 44 penetrating the SUPER SPACER®. Also shown are stamping apertures 47.

Figure 9:
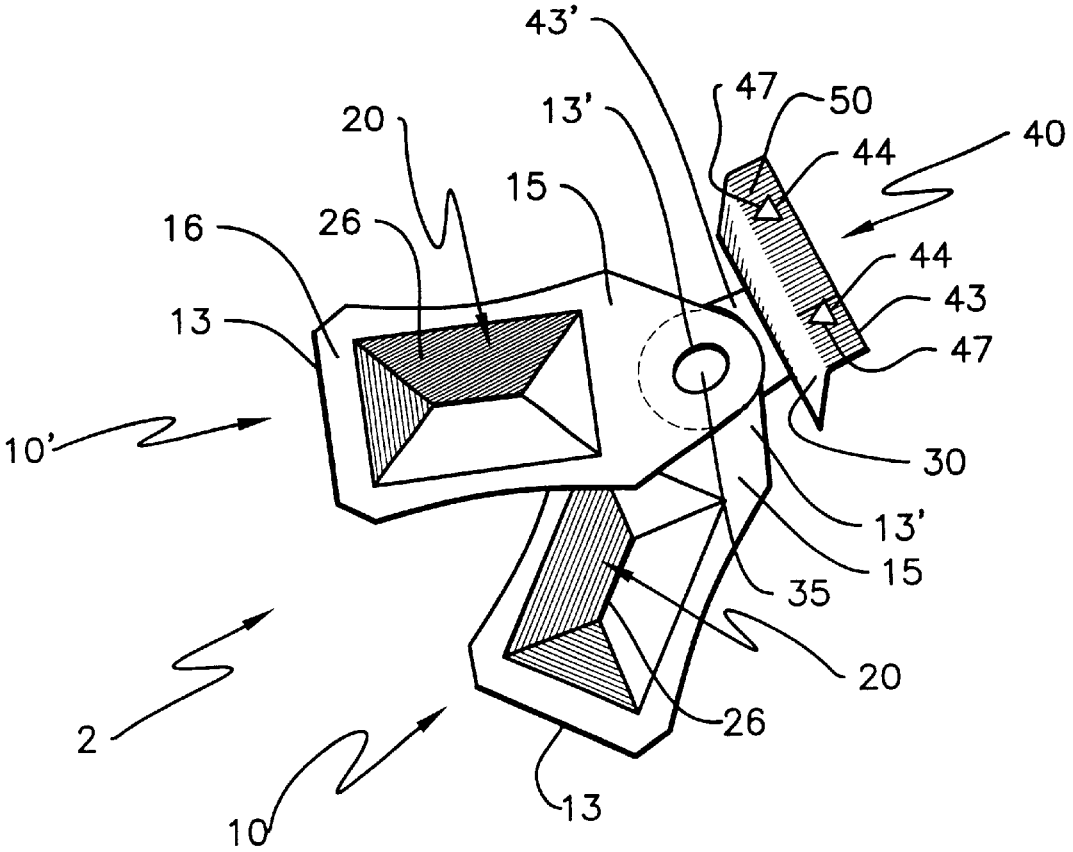

FIG. 9 is a perspective of an alternative embodiment of that shown in FIG. 2 wherein the muntin bar clip 2 has a plurality of posts 10, 10. The respective posts 10, 10 have post ends 13 with post end bevels 14 and post surfaces 15 having first and second sides 16, 17; fastener means 20, formed at the post surface 15 from the first to the second side 16, 17, forming dimples 26; post second ends 13 distal from the post ends 13. Tip 40 having a tip end 43 distal from the post ends 13 terminating in a blunt end 50 with illustrated one or a plurality of spikes 44; the tip 40 having a tip second end 43 distal from the tip end 43. Stamping apertures 47 are shown. An offset 30 formed intermediate the tip 40 and the tip second end 43. Connecting means 35 connecting post 10, 10 and the tip 40 at the post second ends 13 and the tip second end 43' such that post 10, 10 and the tip 40 are rotatably secured by the connecting means providing a swivel function.

Figure 10:
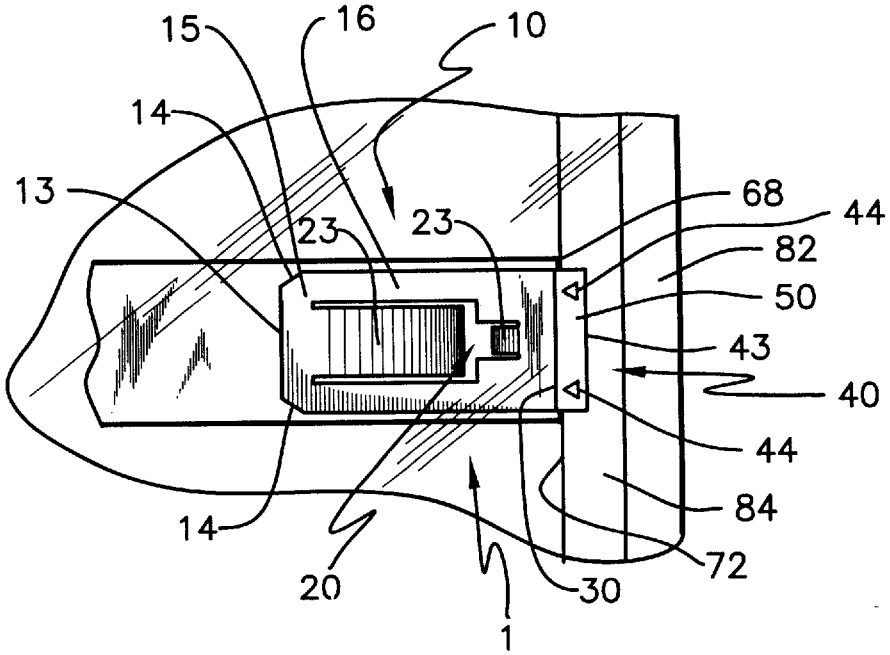

FIG. 10 is a plan view of a muntin bar clip 1 showing one or a plurality of spikes 44.

Figure 11:
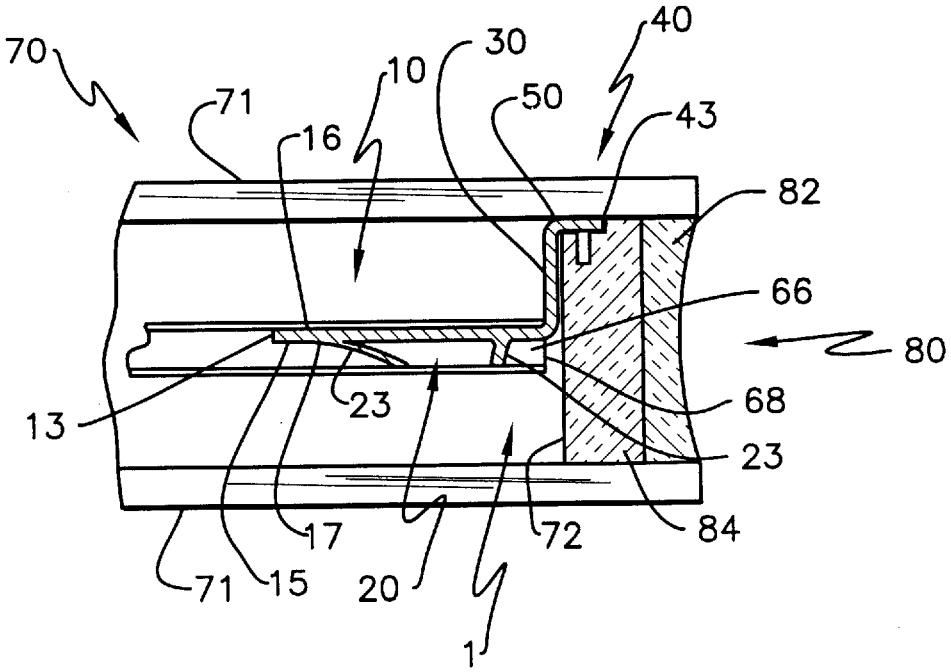

FIG. 11 is a side elevation showing a multi-pane sealed window unit 70 illustrating the use of the invention with a sealing structure 80 comprised of butyl 82, SUPER SPACER® 84.

Figure 12:
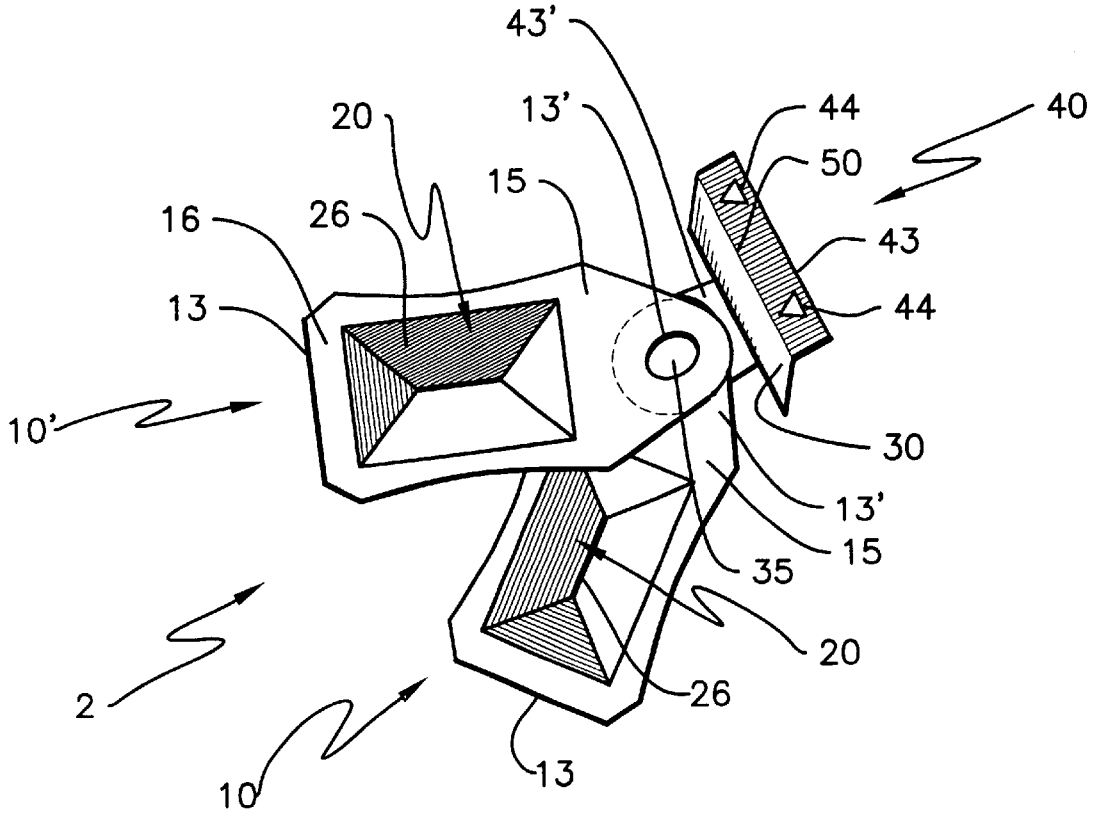

FIG. 12 is a perspective of an alternative embodiment of the invention, showing one or a plurality of spikes 44.

DETAILED DESCRIPTION

The prior art method of fixing of a muntin bar clip in a multi-pane sealed window unit 70 having a perimeter 72 included placement of a tip end 43 between a pane 71 and spacing and or spacing and sealing means 80, 82, 84, 86, 88, 90. Disadvantages of this method includes the possible shifting of the muntin bar clip and hence the muntin bar thus resulting in a malformed or disfigured window unit 70.

The preferred embodiment of the present invention seen in FIG. 1 through 9, is a muntin bar clip 1 with a post 10 having a post end 13 with post end bevels 14 and a post surface 15 having a first and second side 16, 17; a fastener means 20 formed in the post 10 at the post surface 15 from the first to the second side 16, 17. The fastener means 20 formed either as a tang fastener 22 having one or a plurality of tang springs 23, having a spring function realized from the material from which the post 10 is manufactured, formed by a cutting or stamping means of the post surface 15 from the first to the second side 16, 17 or as a dimple 25 formed generally by a stamping means of the post surface 15 by deforming the post surface 15 from the first to the second side 16, 17 forming a dimple 26. The tang springs 23 or the dimple 26, formed into a protrusion, is dimensioned to be friction received tightly into a false hollow muntin bar 65, having ends 68, at the end 68. Fastener means 20 is provided by the tang springs 23, dimple 26 or by other means whereby a structure formed at the post 10 will provide a friction securing function when the post 10 is received into an aperture 66 of a hollow false muntin bar 67 at the end 68.

Figure 1:
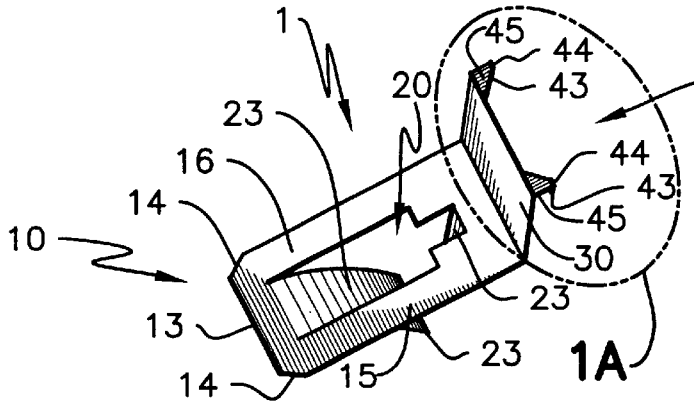
FIG. 1 is a perspective showing the preferred embodiment of a muntin bar clip 1 with a post 10, a post end 13 with post end bevels 14 and a post surface 15 having a first and second side 16, 17; a fastener means 20, formed at the post surface 15 from the first to the second side 16, 17, having one or a plurality of tang springs 23; a tip 40 having a tip end 43 distal from the post end 13 terminating in one or a plurality of prongs 45; an offset 30 formed intermediate the tip 40 and the fastener means 20; spikes 44, formed by means including, for example, stamping and metal forming means, are seen at the prongs 45.
Figure 1A:
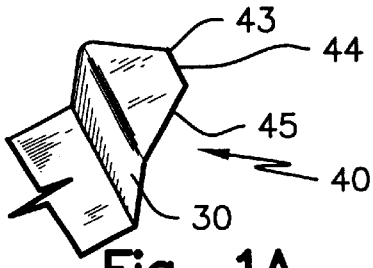
FIGS. 1A and 1B are perspectives of an alternative embodiment of the tip 40 of the muntin bar clip 1 shown in FIG. 1 wherein the tip end 43 terminates in one prong 45 and one spike 44.

The muntin bar clip 1 has a tip 40 having tip first and second side 41, 42 and a tip end 43 distal from the post end 13. The tip end 43 may terminate in one or a plurality of prongs 45, or as a blunt end 50 as shown in FIGS. 1, 1A and 2 through 9. One or a plurality of spikes 44 are formed, by stamping or forming means including metal forming, at the tip end 43; the one or a plurality of spikes 44 project toward the tip second end 43'. Stamping apertures 47 are formed when the one or a plurality of spikes 44 is bent into position. The tip end 43 is secured between a pane 71 and the sealing structure wherein the tip end 43 form is selected such as to lessen the likelihood of breaking or cracking a pane 71 or of violating the sealing structure integrity of the multi-pane construction. The tip end 43, generally formed from sheet metal, is dimensioned to provide material strength sufficient to maintain the position of the hollow false muntin bar 65 relative to the perimeter 72 while of a thickness which will not cause breaking of the pane 71 or create a sealing structure 80 leak. In the preferred embodiment the tip end 43 is formed with one or more prongs 45, shown in FIGS. 1, 1A, 3, 3A, 3B and 3C, or with a blunt end 45, shown in FIGS. 2, 2A, 2B, 2C, 4, 8 and 9; the tip end 43 is received between the sealing structure and the pane 71, for example in the instance of a sealing systems such as the swiggle strip or SUPER SPACER®, between the sealing structure and the pane 71 and into the spacing and/or sealing structure material. The tip end 43 with prongs 45 reduce the area of a tip end 43 to be inserted between the sealing structure and the pane 71, thus reducing the potential for breaking or cracking the glass or violation of the seal either during manufacture or during any subsequent phase of the life of a multi-pane unit. In the preferred embodiment a false hollow muntin bar 65, having an end 68, receives at the end 68 the post 10, at the post end 13, of a muntin bar clip 1. Post end bevels 14 facilitate the insertion of the post end 13 into the end 68. The post 10 is dimensioned to be received into the false hollow muntin bar 65 at the end 68 such as to cause a secure friction fit in combination with the dimension of the fastener means 20. The fastener means 20 is dimensioned to further insure a secure friction fit in the false hollow muntin bar 65. The muntin bar clip 1 has an offset 30 formed intermediate the tip 40 and the fastener means 20. The offset 30 is dimensioned to and serves to center and securely position the false hollow muntin bar 65 between the panes 71 when the post 10 is received and secured into the false hollow muntin bar 65 end 68 and the tip end 43 with one or a plurality of spikes 44 is received between a pane 71 and the spacing and/or sealing structure at the perimeter 72 and the one or a plurality of spikes 44 are received into or penetrate the spacing and/or sealing means. The preferred embodiment for the muntin bar clip 1 is shown in FIG. 1. In the preferred embodiment the false hollow muntin bar 65 is positioned orthogonally in relation to the perimeter 72.

An alternative embodiment of the invention disclosed herein is shown at FIGS. 2, 3 and 4 wherein muntin bar clip 1 is utilized for the positioning of false hollow muntin bars 65 where the false hollow muntin bar 65 will be orthogonal or other than orthogonal relative to the perimeter 72. Where the positioning of the false hollow muntin bar 65 will be other than orthogonal relative to the perimeter 72 the post 10 will be fastened by connecting means including swivel means to the tip 40. Where connecting means 35 is utilized, the post 10 has a post second end 13 distal from the post end 13 and the tip 40 has a tip second end 43' distal from the tip end 43, presenting one or a plurality of spikes 44, and distal from the offset 30. The offset 30 is intermediate the tip end 43 and the tip second end 43'. The connecting means 35 is positioned intermediate the post second end 13 and the fastener means 20 and the tip second end 43' and the offset 30 such that the post 10 and the tip 40 are secured together. The connecting means 35 may be a swivel means such that the post 10 and tip 40 rotate around the connecting means 35. The connecting means 35 may be a rivet providing a swivel function. Where a pattern is to be formed via interconnection of false hollow muntin bars 65 a plurality of posts 10 are interconnected by connecting means 35 including swivel means. The interconnection is positioned intermediate the fastener means 20 and the post second end 13. The fastener means 20 is intermediate the post end 13 and post second end 13. Connecting means 35 may be by swivel means. Connecting means 35 may be, for example, with a rivet and may be formed during a stamping process of the muntin bar clip 1.

Another embodiment of the disclosure is shown at FIG. 9 wherein muntin bar clip 2 has a plurality of posts 10, 10 affixed by connecting means to tip 40 and is utilized for the positioning of more than one false hollow muntin bars 65 where the false hollow muntin bars 65 will be other than orthogonal relative to the perimeter 72.

In another embodiment the tip end 43 terminates in a blunt end (50); the blunt end (50) generally flat defining a plane; one or a plurality of spikes 44 formed by forming means at the blunt end (50) intermediate the tip end (43) and the offset (30); the one or a plurality of spikes (44) generally orthogonal to the plane of the blunt end (50). The one or a plurality of spikes 44 are generally parallel to the offset 30. A tip second end (43') is formed intermediate the the fastener means (20) and the offset (30). The offset (30) generally flat and defining a plane.

The muntin bar clip shown in FIG. 1 through 9 may be formed from a material capable of formation by stamping or cutting including, for example, sheet metal, plastics, composite materials and other materials. The muntin bar clip 1, of FIG. 1 and FIG. 5–8, including tip 40 and post 10, may be formed from a single unit of material. Muntin bar clips 2, 3, 4 and 9 are formed from multiple units of material, including for example sheet metal.

While a preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

I claim:

1. A muntin bar clip comprising:

A. at least one post 10 having a post end 13, a post surface 15 and fastener means 20 formed at the post surface 15;

B. a tip 40 having a tip end 43 distal from the post end 13; and offset 30 formed intermediate the tip 40 and the fastener means 20; a tip second end (43') intermediate the fastener means (20) and the offset (30);

C. the tip end 43 terminates in a blunt end (50); the blunt end (50) generally flat defining a plane; one or a plurality of spikes 44 formed by forming means at the blunt end (50) intermediate the tip end (43) and the offset (30); the one or a plurality of spikes (44) generally orthogonal to the plane of the blunt end (50).

2. A muntin bar clip according to claim 1 wherein:

A. the one or a plurality of spikes 44 are generally parallel to the offset 30; fastener means (20) composed of one or a plurality of dimples (25).

3. A muntin bar clip according to claim 1 wherein:

A. a false hollow muntin bar 65 has an end 68 and an aperture 66; the aperture 66 receives at the end 68 the post 10, at the post end 13;

B. a multi-pane sealed window unit 70 having panes 71 and a perimeter 72; a sealing structure 80 at the perimeter 72; hollow false muntin bars received between the panes 71; the blunt end (50) is dimensioned to be secured between a pane 71 and the sealing structure;

C. the offset 30 is dimensioned to center and securely position the false hollow muntin bar 65 between the panes 71 when the post 10 is received and secured into the false hollow muntin bar 65 aperture 60 at an end 68 and the blunt end (50) and one or a plurality of spikes 44 is received between a pane 71 and the sealing structure 80, at the perimeter 72; the one or a plurality of spikes 44 received into the sealing structure 80 fixing the position of the false hollow muntin bar 65.

4. A muntin bar clip comprising:

A. at least one post 10 having a post end 13 and a post second end 13 distal from the post end 13; fastener means 20 formed in the post 10 at a post surface 15 from the first to the second side 16, 17 intermediate the post end 13 and post second end 13;

B. a tip 40 has a tip end 43 and a tip second end 43' distal from the tip end 43; the tip 40 having an offset 30 intermediate the tip end 43 and tip second end 43'; the tip end 43 terminates in a blunt end (50); the blunt end (50) generally flat defining a plane; one or a plurality of spikes 44 formed by forming means at the blunt end (50) intermediate the tip end (43) and the offset (30); the one or a plurality of spikes (44) generally orthogonal to the plane of the blunt end (50).

C. connecting means 35 is positioned intermediate the post fastener means 20 and the offset 30 such that the post 10 and the tip 40 are rotatably secured.

5. A muntin bar clip according to claim 4 wherein:

A. the one or a plurality of spikes 44 are generally parallel to the offset 30 and project toward the plane of the blunt end 50.

6. A muntin bar clip of claim 5 where the connecting means 35 is a swivel means; the one or a plurality of spikes 44 formed by forming means and positioned generally with the a plane of the offset 30.

7. A muntin bar clip of claim 4 where the connecting means 35 is a swivel means.

8. A muntin bar clip comprising:

A. a plurality of posts each having a post end 13 and a post second end 13 distal from the post end 13; fastener means 20 formed in each post at a post surface 15 from a first to a second side 16, 17 intermediate the post end 13 and post second end 13;

B. a tip 40 has a tip end 43 and a tip second end 43' distal from the tip end 43; the tip 40 having an offset 30 intermediate the tip end 43 and tip second end 43'; the tip end 43 terminates in a blunt end (50); the blunt end (50) generally flat defining a plane; one or a plurality of spikes 44 formed by forming means at the blunt end (50) intermediate the tip end (43) and the offset (30); the one or a plurality of spikes (44) generally orthogonal to the plane of the blunt end (50);

C. connecting means 35 is positioned intermediate each post fastener means 20 and the offset 30 such that the plurality of posts and the tip 40 are rotatably secured;

D. a false hollow muntin bar 65 has an end 68 and an aperture 66; the aperture 66 receives at the end 68 the post 10, at the post end 13;

E. a multi-pane sealed window unit 70 having panes 71 and a perimeter 72; a sealing structure 80 at the perimeter 72; hollow false muntin bars received between the panes 71; the tip end 43 is dimensioned to be secured between a pane 71 and the sealing structure;

F. the offset 30 is dimensioned to center and securely position the false hollow muntin bar 65 between the panes 71 when the post 10 is received and secured into the false hollow muntin bar 65 aperture 66 at an end 68 and the tip end 43 and one or a plurality of spikes 44 is received between a pane 71 and the sealing structure at the perimeter 72; the one or a plurality of spikes 44 received into the sealing structure 80 fixing the position of the false hollow muntin bar 65.

* * * * *